United States Patent [19]

Kaneko et al.

[11] 4,247,193

[45] Jan. 27, 1981

[54] ELECTROSTATIC COPYING MACHINE COMPRISING JAM SENSORS

[75] Inventors: Tamaki Kaneko; Kenichi Mizuma; Tugio Okuzawa; Masao Hosaka, all of Tokyo, Japan

[73] Assignee: Ricoh Co., Ltd., Tokyo, Japan

[21] Appl. No.: 28,905

[22] Filed: Apr. 10, 1979

[30] Foreign Application Priority Data

Apr. 21, 1978 [JP] Japan ..... 53/46712

[51] Int. Cl.[3] ..... G03G 15/00

[52] U.S. Cl. ..... 355/14 R; 355/3 SH

[58] Field of Search ..... 355/3 R, 3 SH, 14 R, 355/14 SH

[56] References Cited

U.S. PATENT DOCUMENTS 3,603,680 9/1971 Barton ..... 355/3 R 4,054,380 10/1977 Donohue et al. ..... 355/14 R

*Primary Examiner*—Fred L. Braun

*Attorney, Agent, or Firm*—David G. Alexander

[57] ABSTRACT

A plurality of feed units feed a copy sheet (13) down a sheet feed path (41) along which various operating units (18), (37) are disposed. The operating units (18), (37) function to transfer and fix a toner image to the copy sheet (13). Sensors (42), (43), (44), (46), (47) sense for the presence of the copy sheet (13) in the feed units at respective times. Absence of the copy sheet (13) indicates that the copy sheet (13) is jammed or stopped in the previous feed unit. In such a case, all feed units downstream of the feed unit in which the jam is sensed are driven to feed out prior copy sheets (13) in the downstream units. All feed units upstream of and including the feed unit in which the jam is sensed are de-energized to enable the operator to clear the jam.

5 Claims, 18 Drawing Figures

157
CONTROL WORD REGISTER
162
PORT A
PORT B
PORT C
b0
b1
b2
b3
b4
b5
b6
b7
152
CPU
159

SUB 2
SHEET PRESENT
N
Y
JAM 2
SECONDARY SHEET FEED
311
312
OFF
313
314
315
ON
SUB 3
SHEET PRESENT
N
Y
JAM 3
REGISTER
311
312
313
OFF
314
315
ON
SUB 4
SHEET PRESENT
N
Y
JAM 4
TRANSFER
311
312
313
314
OFF
315
ON
SUB 5
SHEET PRESENT
N
Y
JAM 5
FIXING
311
312
313
314
315
OFF
RETURN

ELECTROSTATIC COPYING MACHINE COMPRISING JAM SENSORS

BACKGROUND OF THE INVENTION

The present invention relates to an electrostatic copying machine comprising means for sensing copy sheet jams and other feed failures and feed out copy sheets downstream of the jams.

High speed electrostatic copying machines generally have long sheet feed paths down which a plurality of copy sheets are sequentially fed. As many as four or five copy sheets may be in the feed path at a given time. Disposed along the feed path are operating units which transfer and fix toner images of original documents to the copy sheets to provide permanent reproductions.

Such copying machines are provided with jam sensors which sense for jams of the copy sheets. When a jam is sensed, the entire copying machine is shut down and a visual indication provided which indicates the location of the jam. This allows the operator to clear the jam and proceed with the copying operation.

However, at the time the copying machine is shut down, several sheets may be in the feed path undergoing various operations such as toner image transfer and fixing. Interruption of the copying operation during the course of transfer or fixing will result in all or most of the copies being ruined. Such waste is actually unnecessary since the jam affects only the copy sheets upstream of and including the jammed sheet.

SUMMARY OF THE INVENTION

An electrostatic copying apparatus embodying the present invention includes sheet feed means for feeding copy sheets down a sheet feed path and a plurality of operating units disposed along the sheet feed path for forming toner images on the copy sheets, the feed means including a plurality of individually drivable feed units spaced along the feed path. Sensor means sense a copy sheet jam in each of the feed units. Control means cause all of the feed units to be driven when the sensor means does not sense a jam and, when the sensor means does sense a jam, energize only feed units downstream of a feed unit in which the jam is sensed.

In accordance with the present invention, a plurality of feed units feed a copy sheet down a sheet feed path along which various operating units are disposed. The operating units function to transfer and fix a toner image to the copy sheet. Sensors sense for the presence of the copy sheet in the feed units at respective times. Absence of the copy sheet indicates that the copy sheet is jammed in the previous feed unit. In such a case, all feed units downstream of the feed unit in which the jam is sensed are energized to feed out prior copy sheets in the downstream units. All feed units upstream of and including the feed unit in which the jam is sensed are de-energized to enable the operator to clear the jam.

It is an object of the present invention to provide an electrostatic copying machine having a long sheet feed path in which several copy sheets are present at a given time and comprising means for preventing unnecessary waste of copy sheets in the event of a sheet jam.

It is another object of the present invention to provide an electrostatic copying machine comprising improved jam sensing means constructed to cause copy sheets downstream of a jammed copy sheet to be fed out of the machine after being subjected to normal copying operations to produce finished copies.

It is another object of the present invention to provide an electrostatic copying machine comprising a sheet feed means having a plurality of individually drivable sheet feed units and means for energizing only those feed units downstream of a sheet jam when a jam is sensed.

It is another object of the present invention to provide a generally improved electrostatic copying machine comprising jam sensors.

Other objects, together with the foregoing, are attained in the embodiments described in the following description and illustrated in the accompanying drawing.

BRIEF DESCRIPTION OF THE DRAWING

FIG. 6 is a diagram showing how

FIG. 12 is a diagram showing how

DESCRIPTION OF THE PREFERRED EMBODIMENTS

While the electrostatic copying machine comprising jam sensors of the present invention is susceptible of numerous physical embodiments, depending upon the environment and requirements of use, substantial numbers of the herein shown and described embodiments have been made, tested and used, and all have performed in an eminently satisfactory manner.

Figure 1:
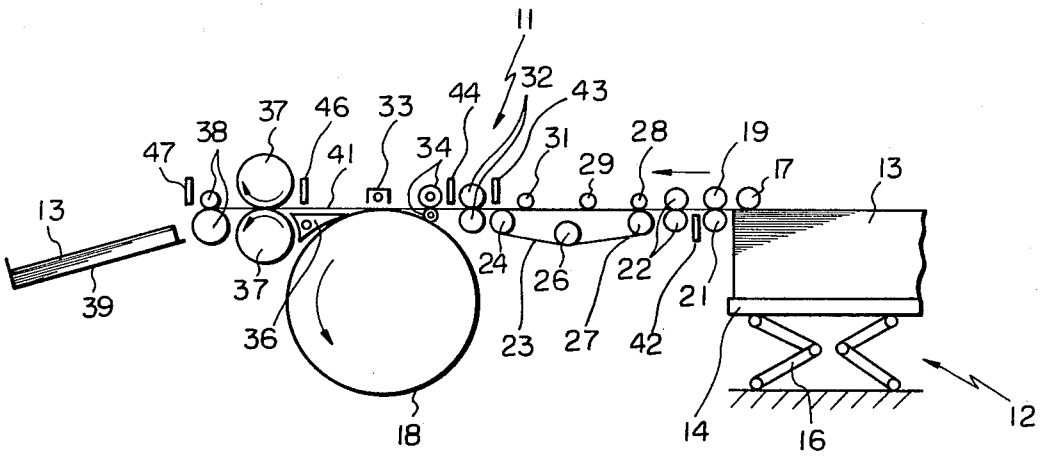
FIG. 1 is a schematic view of a first electrostatic copying machine embodying the present invention.

Referring now to FIG. 1 of the drawing, an electrostatic copying machine embodying the present invention is generally designated by the reference numeral 11 and comprises a sheet support unit 12 for supporting a stack of copy sheets 13. The support unit 12 comprises a plate 14 on which the sheets 13 are placed and an elevator 16 for gradually moving the plate 14 upwardly so that the top sheet 13 is maintained in engagement with a feed roller 17.

The feed roller 17 is rotated clockwise when required to feed the top sheet 13 leftwardly toward a photoconductive drum 18 which is driven for counterclockwise rotation. The sheets 13 are fed between rollers 19 and 21. The roller 19 is rotated clockwise to feed the top sheet 13 toward the drum 18. The roller 21 is also rotated clockwise and urges the sheet 13 back toward the support unit 12. A small gap is provided between the rollers 19 and 21. This arrangement prevents accidental feeding of two sheets 13 together since the lower roller 21 urges the lower sheet 13 back toward the support unit 12.

A pair of rollers 22 cooperate to feed the sheet 13 leftwardly onto a conveyor belt 23 which is trained around rollers 24, 26 and 27. One of the rollers 24, 26 and 27 is rotatably driven counterclockwise to rotate the belt 23 counterclockwise and move the sheet 13 toward the drum 18. Idler rollers 28, 29 and 31 are disposed above the belt 23 to aid in conveyance of the sheet 13.

The belt 23 feeds the sheet 13 into the bite of register rollers 32 which are initially held stationary. Although not illustrated, the drum 18 is initially electrostatically charged and radiated with a light image of an original document. A toner substance is applied to the drum 18 to produce a toner image. A transfer charger 33 is disposed above the drum 18 to transfer the toner image to the sheet 13.

When the leading edge of the toner image reaches a predetermined position, the register rollers 32 are driven to move the sheet 13 into surface contact with the drum 18 at the same surface speed thereof. Additional feed rollers 34 aid in this process.

The toner image is electrostatically transferred to the sheet 13 by means of the charger 33 and the sheet 13 is separated from the drum 18 by a pawl 36. The sheet 13 is then fed between fixing rollers 37 which fix the toner image to the sheet 13 by means of heat, pressure or a combination thereof. The sheet 13, which is now a finished copy, is discharged by rollers 38 into a discharge tray 39 for use.

A sheet feed path of the sheets 13 is designated as 41 and comprises a plurality of sections which are not given individual reference numerals but which will be discussed descriptively. In accordance with the present invention, a plurality of sensors are disposed along the sheet feed path 41 to sense the presence or absence of a sheet 13 at predetermined places and times. The sensors may be microswitches, photosensors or the like.

A sensor 42 is disposed between the rollers 19 and 21 and the rollers 22. Another sensor 43 is disposed between the belt 23 and rollers 32. Another sensor 44 is disposed between the rollers 32 and 34. Another sensor 46 is disposed between the area of engagement of the drum 18 and pawl 36 and the fixing rollers 37. Yet another sensor 47 is disposed between the rollers 38 and the tray 39.

The sensors 42, 43, 44, 46 and 47 divide the feed path 41 into six sections: a primary feed section upstream (rightward) of the sensor 42, a secondary feed section between the sensors 42 and 43, a register section between the sensors 43 and 44, a transfer section between the sensors 44 and 46, a fixing section between the sensors 46 and 47 and a discharge section downstream (leftward) of the sensor 47. In accordance with an important feature of the present invention, the various feed means or members for feeding the sheets through the sections of the sheet feed path 41 are drivable on an individual basis. It will be further understood that due to the length of the sheet feed path 41, a plurality of sheets 13 may be present in the sheet feed path 41 at any given time during a continuous copying operation.

Although not shown in FIG. 1, a control means which may comprise a microcomputer is constructed to test the outputs of the sensors 42, 43, 44, 46 and 47 to determine the presence of a sheet 13 at the sensor positions at predetermined respective times. The times correspond to the lengths of time required for the sheets 13 to be fed from the support unit 12 to the respective sensors.

Assuming that a sheet 13 jams in the rollers 19 and 21 or is not fed by the roller 17, it will not reach the sensor 42. Thus, at the time the sheet 13 should reach the sensor 42, the sensor 42 will produce an output indicating absence of the sheet 13. In response, the control unit will de-energize the rollers 17, 19 and 21 to allow the operator to clear the jam. However, the control unit will continue to energize or drive all of the feed means downstream of the sensor 42, including the rollers 22, belt 23, rollers 32, rollers 34, drum 18, rollers 37 and rollers 38 so that the sheets 13 downstream of the jam will be processed and fed out in a normal manner. The control means is programmed to keep track of all sheets 13 in the feed path 41.

Assuming that the sheet 13 passes the sensor 42 but jams upstream of the sensor 43, the rollers 19, 21, 22 and belt 23 will be stopped or de-energized but all feed units downstream of the sensor 43 will be maintained energized. If the sheet passes the sensor 43 but jams in the register rollers 32, all feed units upstream of the sensor 44 including the register rollers 32 will be de-energized but all feed units downstream of the sensor 44 will be energized.

If the sheet 13 is sensed by the sensor 44 but not by the sensor 46 at the later predetermined time, all feed units upstream of the sensor 46, including the rollers 34 and drum 18 will be stopped. If the sheet 13 passes the sensor 46 but is not detected by the sensor 47, all feed units in the machine 11 will be stopped. In all cases, all feed units in the machine 11 will be stopped after sufficient time has elapsed for all copy sheets 13 downstream of the jam to be processed and discharged into the tray 39. It will thus be appreciated that the sensors 42, 43, 44, 46 and 47 sense for the presence or absence of sheets 13 in the various sections of the feed path 41. For example, if the sheet 13 is sensed by the sensor 42 but not by the sensor 43, it indicates that the leading edge of the sheet 13 has not reached the register section between the sensors 43 and 44.

The present copying machine or apparatus 11 advantageously prevents waste of copy sheets 13 by feeding out sheets 13 downstream of a jam position after processing these sheets 13 in the normal manner to produce finished copies. This is in contrast to the prior art in which the entire copying machine is shut down upon sensing of a jam and all copy sheets in the sheet feed path are ruined and thereby wasted.

Figure 2:
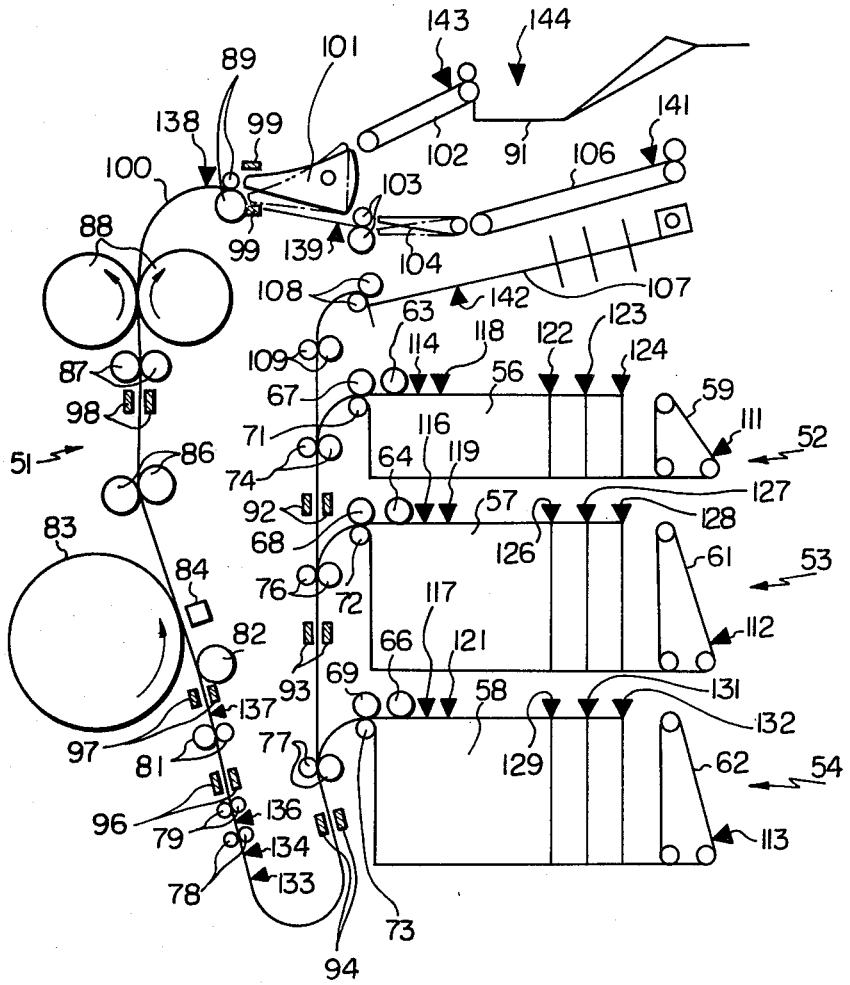
FIG. 2 is a schematic view of a second electrostatic machine embodying the present invention.

FIG. 2 illustrates an electrostatic copying machine 51 which operates on the same basic principles as the copying machine 11 but has additional features. The copying machine 51 is provided with three sheet support units 52, 53 and 54 for supporting three stacks of copy sheets 56, 57 and 58 of different sizes. Although not shown, a lever is provided which allows the operator to select one of the units 52, 53 and 54 and thereby the copy sheet size. Each of the units 52, 53 and 54 is identical. However, different sizes of copy sheets 56, 57 and 58 are placed in the units 52, 53 and 54 respectively enclosed in cassettes (not shown).

The units 52, 53 and 54 are provided with elevators 59, 61 and 62 for elevating the stacks of sheets 56, 57 and 58 respectively and provide a function equivalent to the elevator 16 of the apparatus 11. The units 52 53 and 54 are also provided with feed rollers 63, 64 and 66 which provide the function of the feed roller 17 of the apparatus 11. Feed rollers 67, 68 and 69 correspond to the feed roller 19. Feed rollers 71, 72 and 73 correspond to the feed roller 21. Feed roller pairs 74, 76 and 77 correspond to the feed roller pair 22. Feed roller pairs 78 and 79 provide a function equivalent to the conveyor belt 23. Register rollers 81 correspond to the register rollers 32. A roller 82 provides a function equivalent to the rollers 34. A drum 83 and transfer charger 84 correspond to the drum 18 and transfer charger 33. Roller pairs 86 and 87 feed sheets to fixing rollers 88 which correspond to the fixing rollers 37. Discharge rollers 89 correspond to the rollers 38 and discharge sheets into a tray 91 which corresponds to the tray 39.

Figure 4:
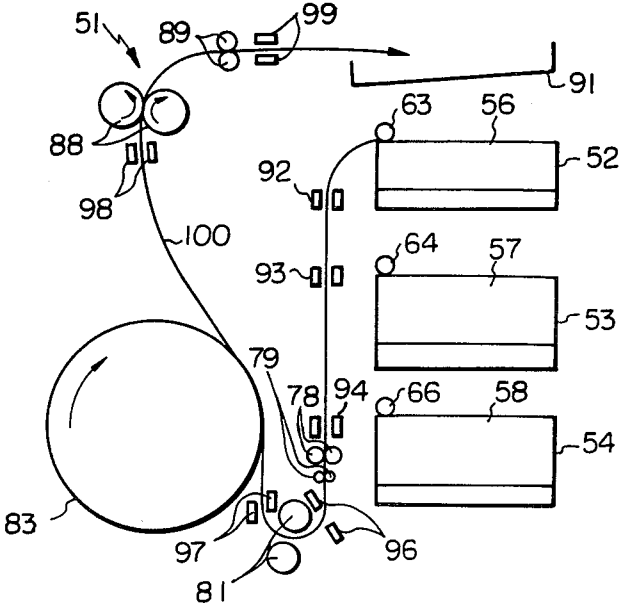
FIG. 4 is a simplified diagram of the copying machine of FIG. 2 illustrating a sheet feed path thereof.
Figure 5:
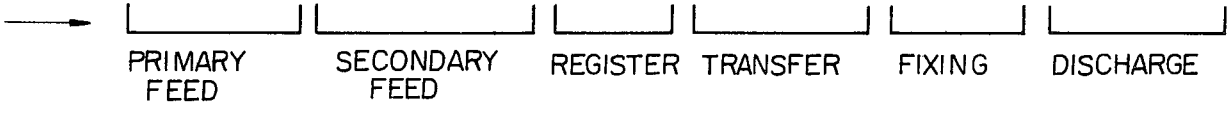
FIG. 5 is a diagram illustrating the sheet feed path of the copying machine of FIGS. 1 or 2.
Figure 6A:
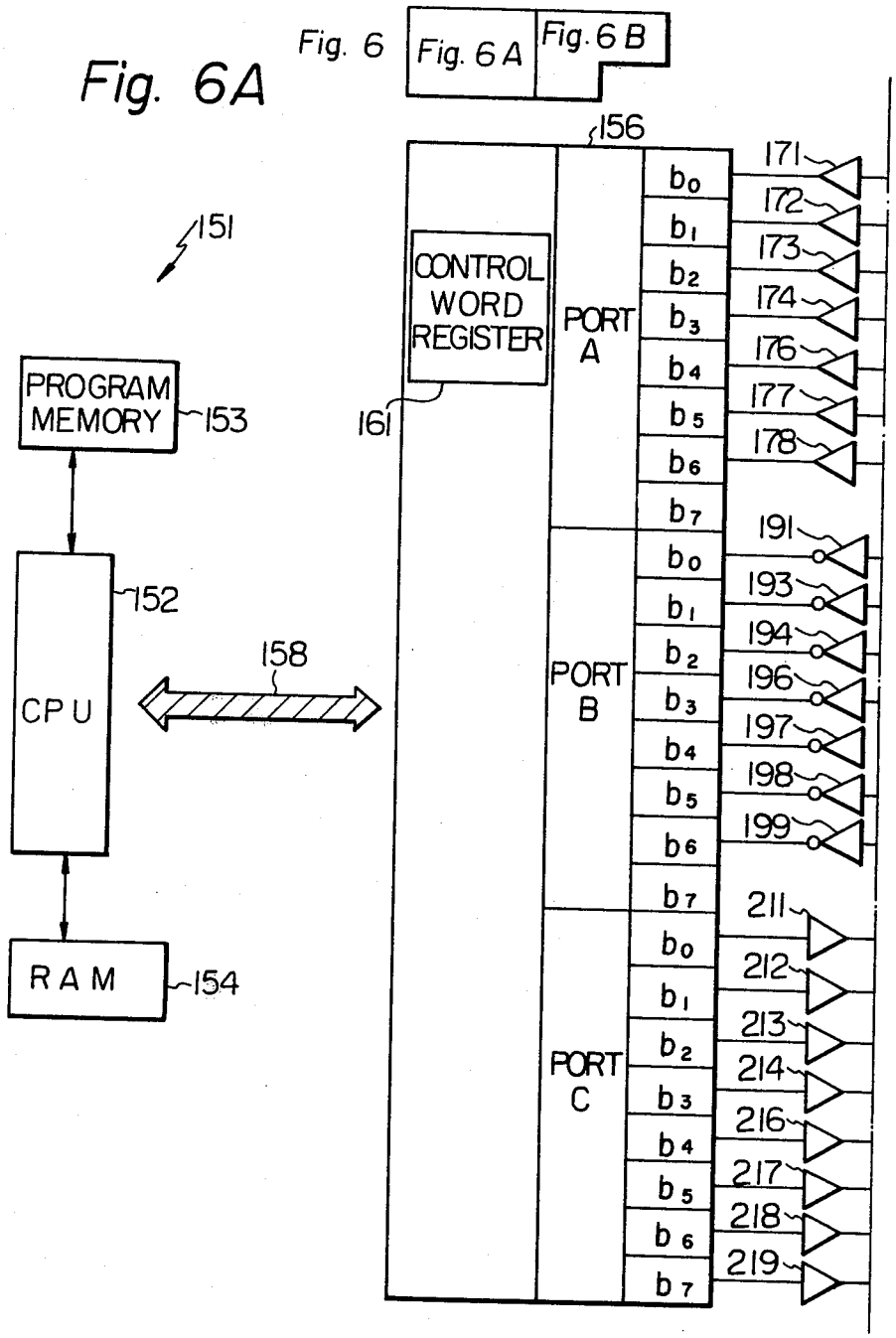
FIGS. 6*a* and 6*b* are combined to constitute a complete schematic diagram of part of a microcomputer controlled sensing and control means of the copying machine of FIG. 2.
Figure 6B:
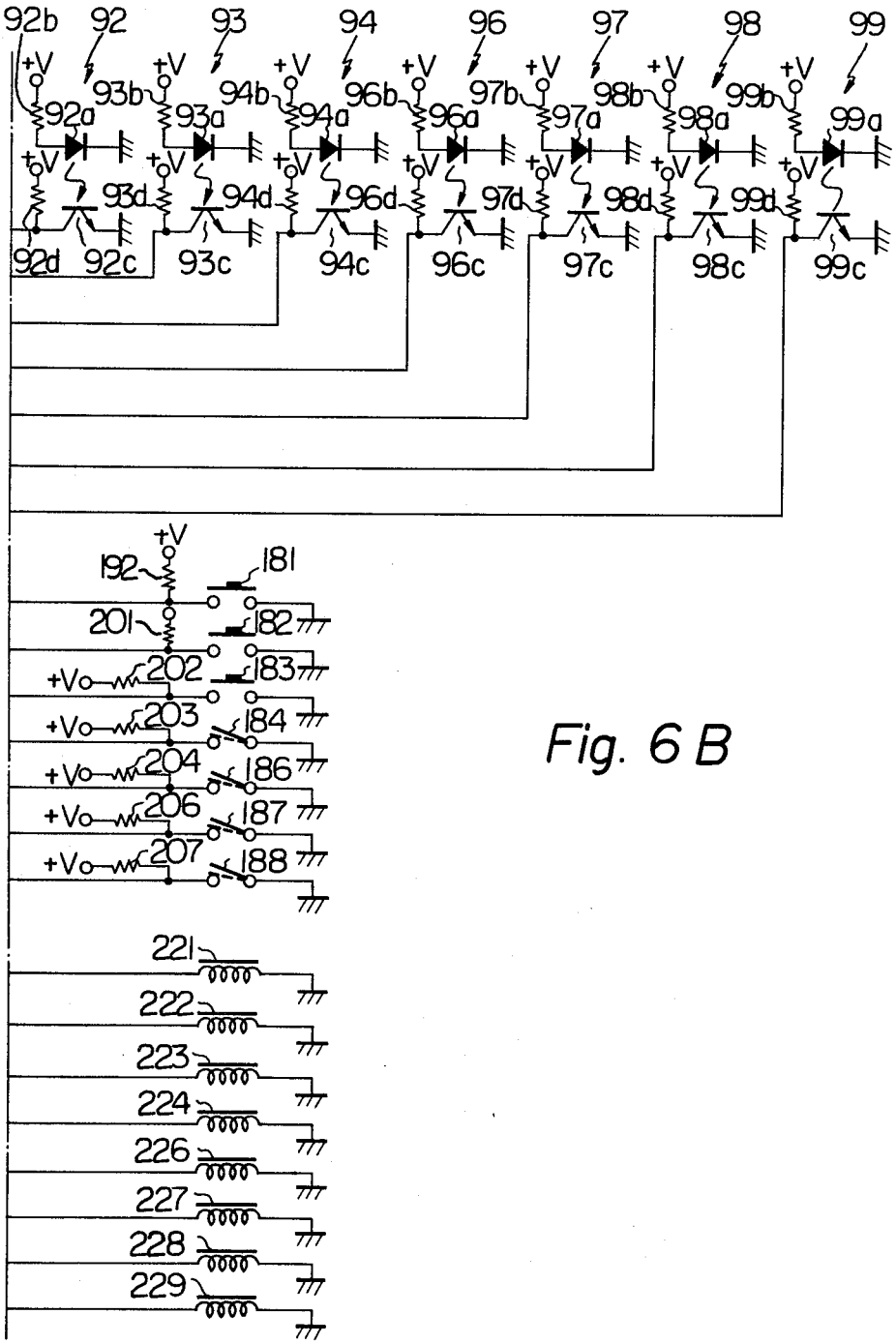
Figures 7, 7A, 7B:
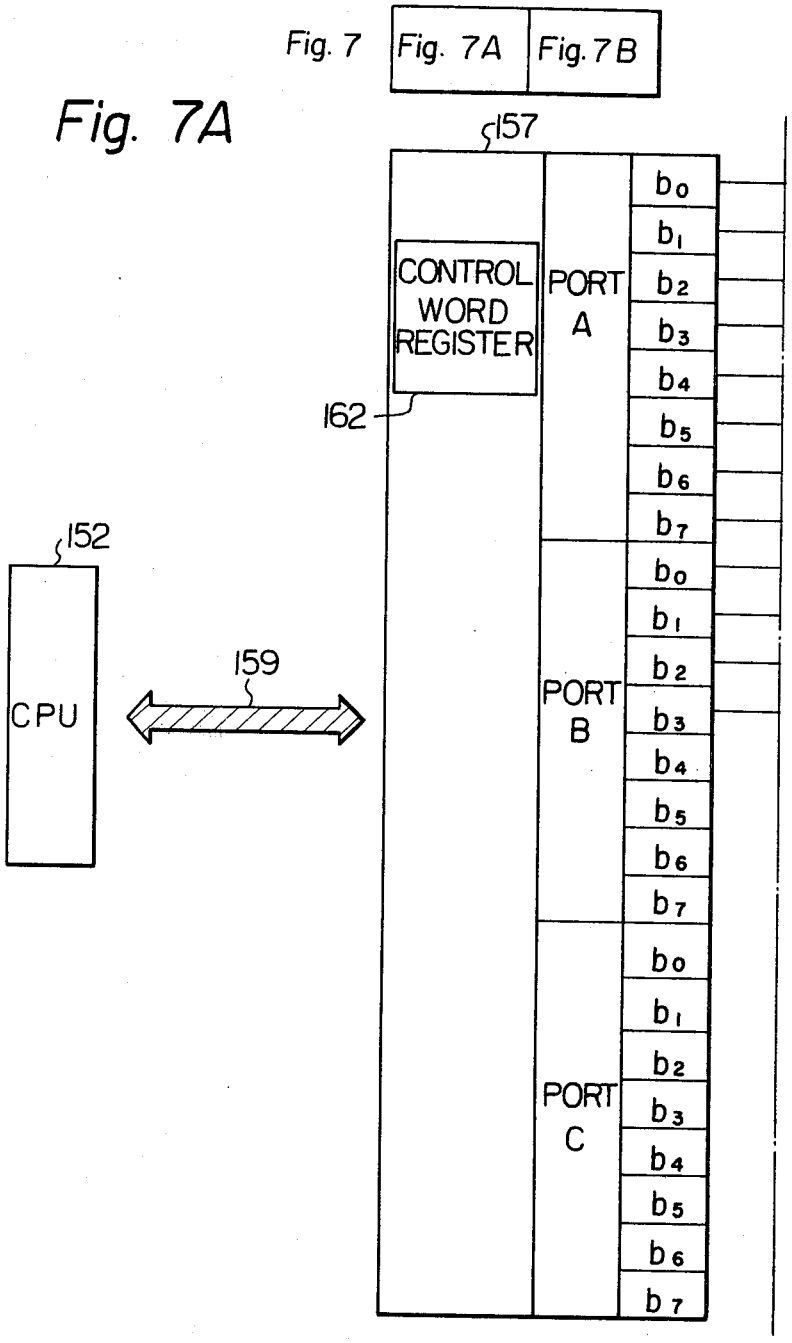
FIG. 7 is a diagram similar to FIG. 6 showing how
FIGS. 7*a* and 7*b* are combined to illustrate another part of the copying machine of FIG. 2.
Figure 7B:
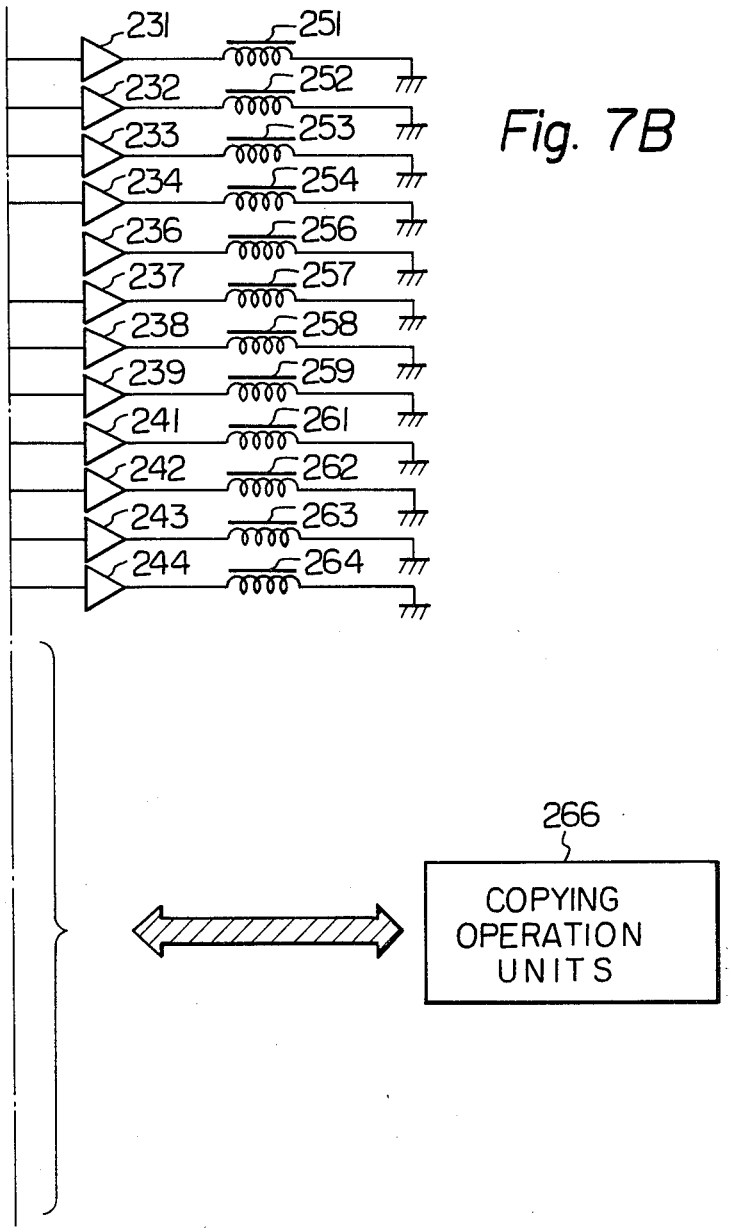

The apparatus 51 further comprises sensors 92, 93 and 94 which provide the same function as the sensor 42 in that they sense feeding of the sheets 56, 57 and 58 out of the support units 52, 53 and 54 respectively. A sensor 96 corresponds to the sensor 43. A sensor 97 corresponds to the sensor 44. A sensor 98 corresponds to the sensor 46. A sensor 99 corresponds to the sensor 47. Each of the sensors 92, 93, 94, 96, 97, 98 and 99 preferably comprises a light source and photosensor which, although not individually designated by reference numerals, are disposed on opposite sides of a sheet feed path 100. When a sheet passes between the light source and photosensor it blocks the light from the light source so that the photosensor produces logically different outputs when the sheet is present or absent respectively. FIG. 4 is a simplified diagram illustrating the sheet feed path 100. FIG. 5 is a diagram illustrating the six sections of the sheet path 100. It will be noted that the sheet feed path 100 has the same sections as the sheet feed path 41.

The apparatus 51 is capable of copying on both sides of a copy sheet and also of making a plurality of copies of a single document and sorting or collating the copies. The apparatus 11 is capable of making a plurality of copies of a single document but only of copying on one side of the sheet.

Figure 3:
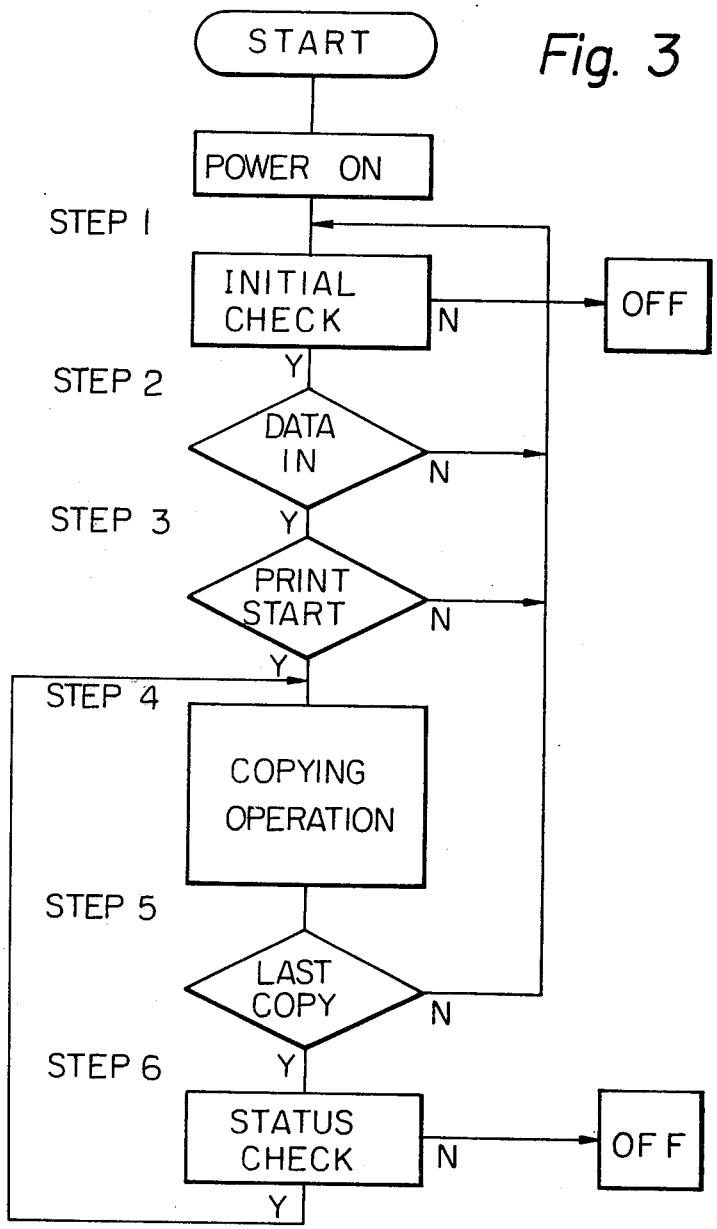
FIG. 3 is a flowchart illustrating the operation of the copying machine of FIGS. 1 or 2.

The flowchart of FIG. 3 is applicable to both copying machines 11 and 51 and illustrates the basic sequence of operation thereof. The copying operation is started by pressing a switch which turns on the main power. Step 1 then consists of an initial check routine which checks the status of various operating components of the machine and turns on a green light or the like when the machine is ready for copying. The items checked in step 1 include an adequate supply of copy sheets and toner, elevation of a fixing heater to a predetermined temperature and the like.

After the green light goes on, step 2 consists of the operator rotating a dial to a position indicating the number of copies to be made. The operator then presses a print start button to constitute step 3.

Step 4 consists of the operation of making one copy. Step 5 consists of comparing the number of copies made with the number of copies set into the machine in step 3. If the last copy has been made, the program loops back to step 1 to repeat the initial check routine. If the last copy has not been made, the machine executes step 6 which constitutes a status check of the machine to determine if the machine is ready and able to make the next copy. If the test is passed, the program loops back to step 4 to make the next copy. In steps 1 to 6, if the test results in failure, the machine is shut down and an appropriate failure indication displayed.

Referring back to FIG. 2, the copying machine 51 comprises a rockable guide 101. With the guide 101 in a lower phantom line position, a copy sheet is guided over the guide 101 onto a conveyor 102 which discharges the sheet into the tray 91. With the guide 101 in an upper solid line position, the sheet is guided under the guide 101 into the bite of feed rollers 103 which feed the sheet to a rockable guide 104.

For making a single copy of a document on one side of a copy sheet, the guide 101 is moved to the lower position and the sheet discharged onto the tray 91. For making a plurality of copies of a single document on one side of respective copy sheets, the guide 101 is moved to the upper position to guide the sheets to the rollers 103 and guide 104. The guide 104 is moved to a lower phantom line position to guide the sheets thereover to a conveyor 106 which conveys the sheets to a sorting or collating unit (not shown). For making one copy on both sides of a copy sheet, the guide 101 is moved to the upper position to guide the sheets to the rollers 103 and guide 104. The guide 104 is moved to an upper solid line position to guide the sheet thereunder onto an inclined plate 107.

After the sheet is discharged onto the plate 107 by the rollers 103, it slides by gravity into the bite of feed rollers 108 which feed the sheet back down the path 100 in cooperation with feed rollers 109. Discharge of the sheet onto the plate 107 and subsequent feeding thereof back down the path 100 has the effect of turning the sheet over. Thus, whereas a first or front surface of the sheet engages with the drum 83 and a toner image is transferred thereto when the sheet is initially fed from the selected support unit 52, 53 or 54, the second or back side of the sheet engages with the drum 83 when the sheet is fed thereto from the plate 107. This allows another toner image to be transferred to the back side of the sheet during the second movement down the path 100. The guide 101 will be moved to the lower position to guide the sheet onto the tray 91 after the second transfer operation.

The jam sensing operation for the copying machine 51 is essentially similar to that of the copying machine 11. The only difference is that only one of the sensors 92, 93 or 94 will be tested depending on whether the sheets 56, 57 or 58 are selected to be fed out of the support units 52, 53 or 54 respectively.

Although not relating to sheet feed jam sensing, the machine 51 comprises a plurality of additional sensors such as microswitches for sensing the status of the machine 51. It will be understood that the jam sensing and control operation of the present invention relates to sensing of any type of feed failure including a jam, since a jam results in a feed failure. A feed failure may also result from a failure of feed rollers to grip and feed a sheet or a breakdown of feed drive means. The present sensors function to sense any type of feed failure regardless of the cause.

The additional sensors include sensors 111, 112 and 113 provided to the elevators 59, 61 and 62 respectively to sense the position of the elevators 59, 61 and 62 and indicate when the number of sheets 56, 57 and 58 drops below a certain level. Sensors 114, 116 and 117 sense the absence of any sheets 56, 57 and 58 in the units 52, 53 and 54 respectively. Sensors 118, 119 and 121 sense when the top sheets 56, 57 and 58 firmly engage the feed rollers 63, 64 and 66 and are capable of being fed. Sensors 122, 123 and 124 sense whether the sheets 56 are B5, A4 or B4 size respectively. Sensors 126, 127 and 128 sense whether the sheets 57 are B5, A4 or B4 size. Sensors 129, 131 and 132 sense whether the sheets 58 are B5, A4 or B4 size.

Sensors 133, 134 and 136 sense for the presence of B4, A4 and B5 size sheets in the vicinity of the rollers 78 and 79. A sensor 137 senses for presence of sheets just downstream of the register rollers 81. A sensor 138 senses for presence of sheets just upstream of the bite of the rollers 89. A sensor 139 senses for the presence of sheets just upstream of the bite of the rollers 103. A sensor 141 senses for the presence of sheets at the discharge end of the conveyor 106. A sensor 142 senses for the presence of sheets on the plate 107. A sensor 143 senses for presence of sheets at the discharge end of the conveyor 102. A sensor 144 senses for the presence of sheets in the tray 91. The sensors 111 to 144 produce outputs which are tested by the control means and used in controlling the timing of operation of the copying machine 51. In addition, various other sensors which are not shown are provided to sense ambient conditions and control the exposure intensity, charging voltages, developing bias voltage and other operating parameters of the copying machine 51.

FIGS. 6 to 11 illustrate how the copying machine 51 is controlled by a microcomputer 151. The microcomputer 151 comprises a central processing unit (CPU) 152. The operating program of the copying machine 51 is stored in a program memory 153 in the form of steps and subroutines which are read out by the CPU 152 in a programmed sequence. A random access memory (RAM) 154 is also provided to store intermediate data from the CPU 152. The CPU 152 controls the operating units of the copying machine 51 through input-output interfaces 156 and 157 via bidirectional data busses 158 and 159 respectively. The interface 156 comprises three input-output ports designated as A, B and C, each having eight input-output terminals designated as b0 to b7. The CPU 152 feeds a control word to the interface 156 which stores the same in a control word register 161. The control word causes corresponding input-output terminals to function as either input or output terminals and enables those input-output terminals which are desired to be used. A typical input-output interface which may be used in the present machine 51 and is commercially available as an off-the-shelf item is the 8255 Programmable Peripheral Interface made by the INTEL Co. The interface 157 is identical to the interface 156 and comprises a control word register 162. The 8085A made by the INTEL Co. may be employed as the CPU 152.

The sensors 92, 93, 94, 96, 97, 98 and 99 are connected through buffers 171, 172, 173, 174, 176, 177 and 178 to the b0 to b6 terminals of the port A of the interface 156. The sensors 92 to 99 are identical and each comprise a light emitting diode designated by the reference numeral designating the respective sensor 92 to 99 suffixed by the character a. The cathodes of the LEDs 92*a* to 99*a* are grounded and the anodes thereof are connected to a positive D.C. power source +V through resistors 92*b* to 99*b* respectively.

Disposed on the opposite side of the sheet feed path 100 from the LEDs 92*a* to 99*a* are NPN photo-transistors 92*c* to 99*c* respectively, the emitters of which are grounded. The collectors of the photo-transistors 92*c* to 99*c* are connected to the source +V through pull-up resistors 92*d* to 99*d* and also to the inputs of the buffer amplifiers 171 to 178 respectively. The terminals b0 to b6 of port A of the interface 156 are connected to function as inputs. When a sheet is present, the respective photo-transistor 92*c* to 99*c* is turned off and the buffer 171 to 178 produces a high output, and vice-versa.

A copy start switch 181 is connected between ground and an input of an inverting buffer 191. A pull-up resistor 192 is connected between the input of the buffer 191 and the source +V. When the switch 181 is open, the buffer 191 produces a low output and vice-versa. The output of the buffer 191 is connected to the terminal b0 of port B of the interface 156 which is connected to function as an input. Switches 182, 183, 184, 186, 187 and 188 are connected to the terminals b1 to b6 of port B of the interface 156 through inverting buffers 193, 194, 196, 197, 198 and 199, are provided with pull-up resistors 201, 202, 203, 204, 206 and 207 respectively, and function in the same manner as the switch 181. The switches 181, 182 and 183 are manually operated whereas the switches 184, 186, 187 and 188 are automatically operated. The switch 182 is a copy stop switch. The switch 183 is a reset switch for restoring operation to the machine 51 after clearing a jam. The switch 184 indicates whether a toner supply is sufficient. The switch 186 indicates whether a toner dispersant supply is sufficient. The switch 187 indicates whether the developing bias voltage is proper. The switch 188 indicates whether the developing unit is operating properly.

The terminals b0 to b7 of port C of the interface 156 are connected to inputs of buffers 211, 212, 213, 214, 216, 217, 218 and 219, the outputs of which are connected to ground through electromagnets 221, 222, 223, 224, 226, 227, 228 and 229 respectively. In an essentially similar manner, the terminals b0 to B7 of port A and terminals b0 to B3 of port B of the interface 157 are connected to ground through buffers 231, 232, 233, 234, 236, 237, 238, 239, 241, 242, 243, and 244 and electromagnets 251, 252, 253, 254, 256, 257, 258, 259, 261, 262, 263 and 264 respectively. Terminals b4 to B7 of port B and terminals b0 to B7 of port C are connected to various operating units of the machine 51 which are collectively designated as 266.

Figure 8:
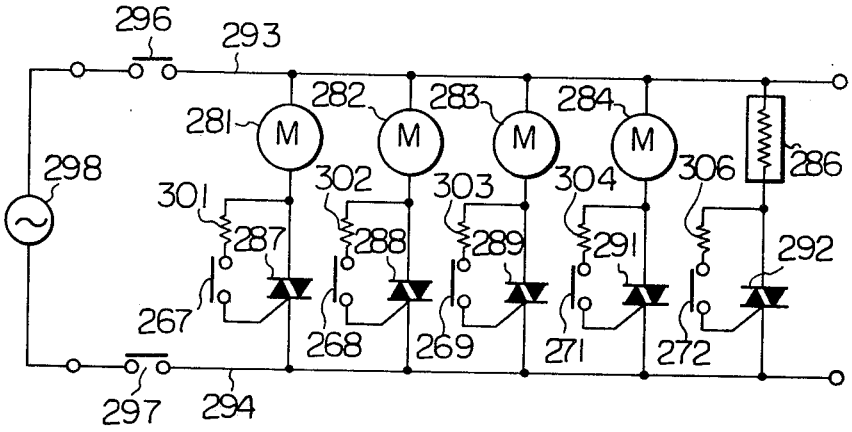
FIG. 8 is an electrical schematic diagram showing another part of the copying machine of FIG. 2.

The electromagnets 221, 222, 223, 224, 226, 227, 228 and 229 are disposed adjacent to reed switches 267, 268, 269, 271, 272, 273, 274, 276 and 277 illustrated in Fig. 8 respectively so that a high output of the buffer 211, 212, 213, 214, 216, 217, 218 or 219 cause the corresponding electromagnet 221, 222, 223, 224, 226, 227, 228 and 229 to be energized and close the adjacent reed switch 267, 268, 269, 271, 272, 273, 274, 276 and 277.

Motors 281, 282, 283, 284 and a fixing heater 286 for the rollers 88 are connected across AC power bus lines 293 and 294 in series with triacs 287, 288, 289, 291 and 292 respectively. Power switches 296 and 297 which are ganged together connect the bus lines 293 and 294 across an AC power source 298.

The reed switches 267 to 272 are connected in series with resistors 301, 302, 303, 304 and 306 between the gate and an anode of the triacs 287 to 292 respectively. When the switches 267 to 272 are closed, the triacs 287 to 292 are turned on to energize the respective motor 281 to 284 and heater 286.

The motor 281 is a main drive motor of the machine 51. The motor 282 supplies drive energy to the feed rollers 63, 67 and 71 of the unit 52. The motor 283 supplies drive energy to the feed rollers 64, 68 and 72 of the unit 53. The motor 284 supplies drive force for the feed rollers 66, 69 and 73 of the unit 54.

Figure 9:
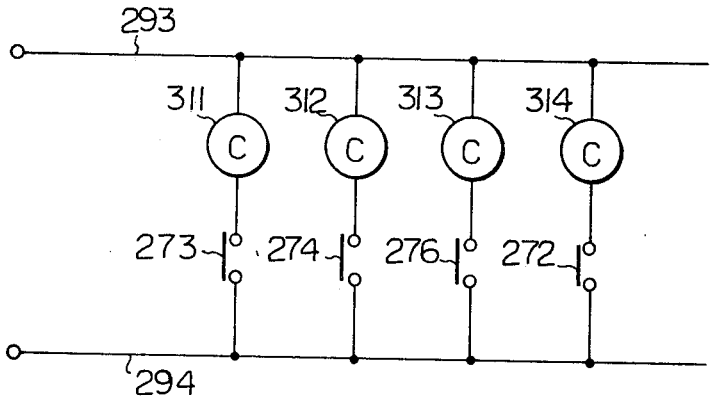
FIG. 9 is an electrical schematic diagram showing another part of the copying machine of FIG. 2.

The reed switches 273, 274, 276 and 277 are connected in series with electromagnetic clutches 311, 312, 313 and 314 as shown in FIG. 9 across the bus line 293 and 294 respectively. The clutch 311 collectively represents individual clutches provided to the rollers 63, 67, 71, 64, 68, 72, 66, 69 and 73 respectively, although not shown, to connect said rollers to the motors 282, 283 and 284. The clutch 312 is provided to connect the rollers 78 and 79 to the motor 281. The clutch 313 connects the register rollers 81 to the motor 281. The clutch 314 connects the drum 83 and rollers 82 and 86 to the motor 281. The clutches 311 to 314 are individually engageable by the micro-computer 151 to feed sheets through the corresponding sections of the feed path 100.

Figure 10:
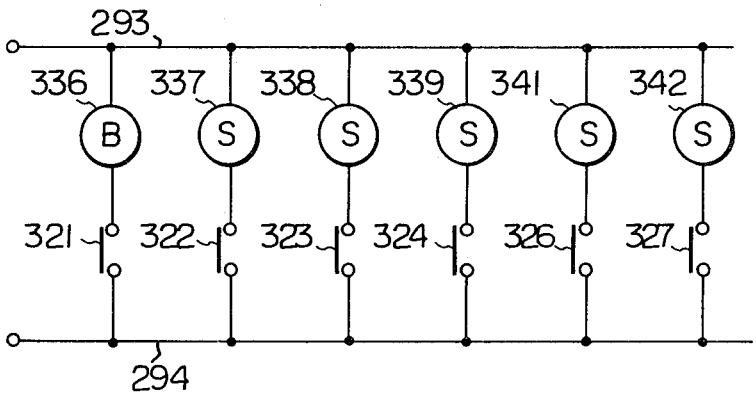
FIG. 10 is an electrical schematic diagram showing another part of the copying machine of FIG. 2.
Figure 11:
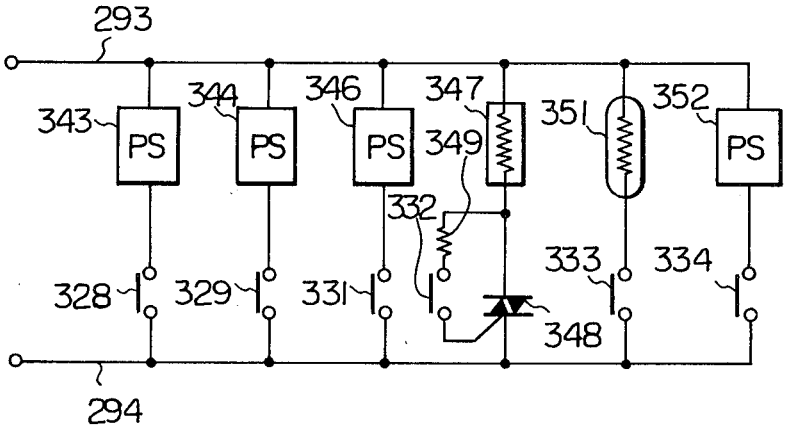
FIG. 11 is an electrical schematic diagram showing another part of the copying machine of FIG. 2.

Referring now to FIGS. 10 and 11, the electromagnets 251, 252, 253, 254, 256, 257, 258, 259, 261, 262, 263 and 264 are provided adjacent to reed switches 321, 322, 323, 324, 326, 327, 328, 329, 331, 332, 333 and 334 respectively. The switches 321 to 327 are connected in series with a brake 336 for the drum 83 and electrical solenoids 337, 338, 339, 341 and 342 respectively across the bus lines 293 and 294. The solenoids 337, 338 and 339 move the feed rollers 63, 64 and 66 into engagement with the sheets 56, 57 and 58 respectively. The solenoid 341 actuates the guide 101. The solenoid 342 actuates the guide 104.

The reed switches 328, 329 and 331 are connected in series with power supplies 343, 344 and 346 across the bus lines 293 and 294. The power supply 343 is for a corona charging unit which applies an initial electrostatic charge to the drum 83. The power supply 344 is for the transfer charger 84. The power supply 346 is for a corona charging unit which discharges the drum 83 after toner image transfer.

A halogen light source for illuminating an original document is designated as 347 and connected in series with a triac 348 across the lines 293 and 294. The reed switch 332 is connected in series with a resistor 349 between an anode and the gate of the triac 348.

The reed switch 333 is connected in series with a lamp 351 across the lines 293 and 294. The lamp 351 is used to illuminate the drum 83 after toner image transfer to discharge the drum 83 and facilitate removal of residual toner therefrom.

The reed switch 334 is connected in series with a power source 352 across the lines 293 and 294. The power source 352 functions to control the temperature of the heater 286.

From the above description, it will be seen that all of the various feed and other units of the copying machine 51 are controlled by the microcomputer 151 in accordance with the outputs of the sensors and the program in the memory 153. The basic operation of the copying machine 51 is not the subject matter of the present invention and will not be described in detail herein.

Figure 12A:
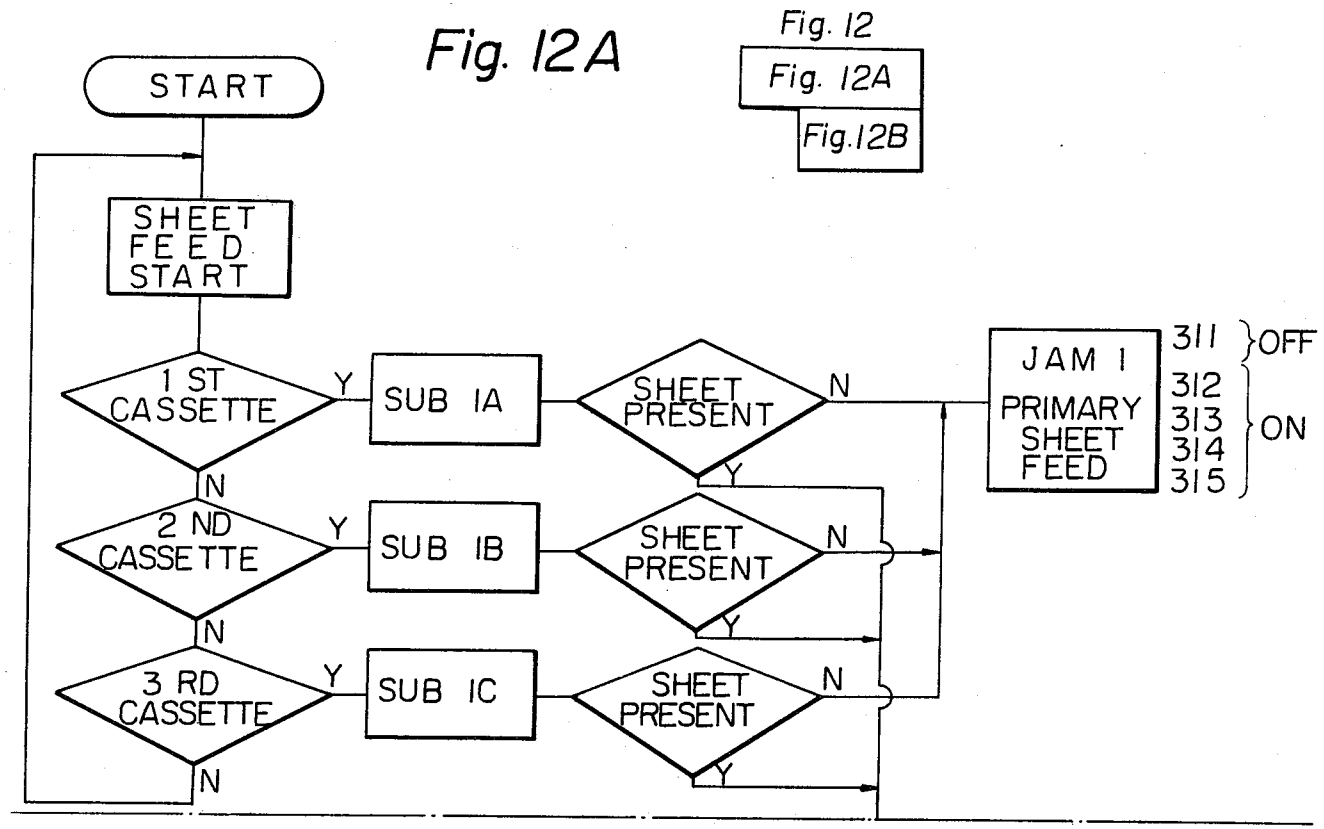
FIGS. 12*a* and 12*b* are combined to constitute a flowchart illustrating the jam sensing and control operation of the copying machine of FIG. 2.
Figure 12B:
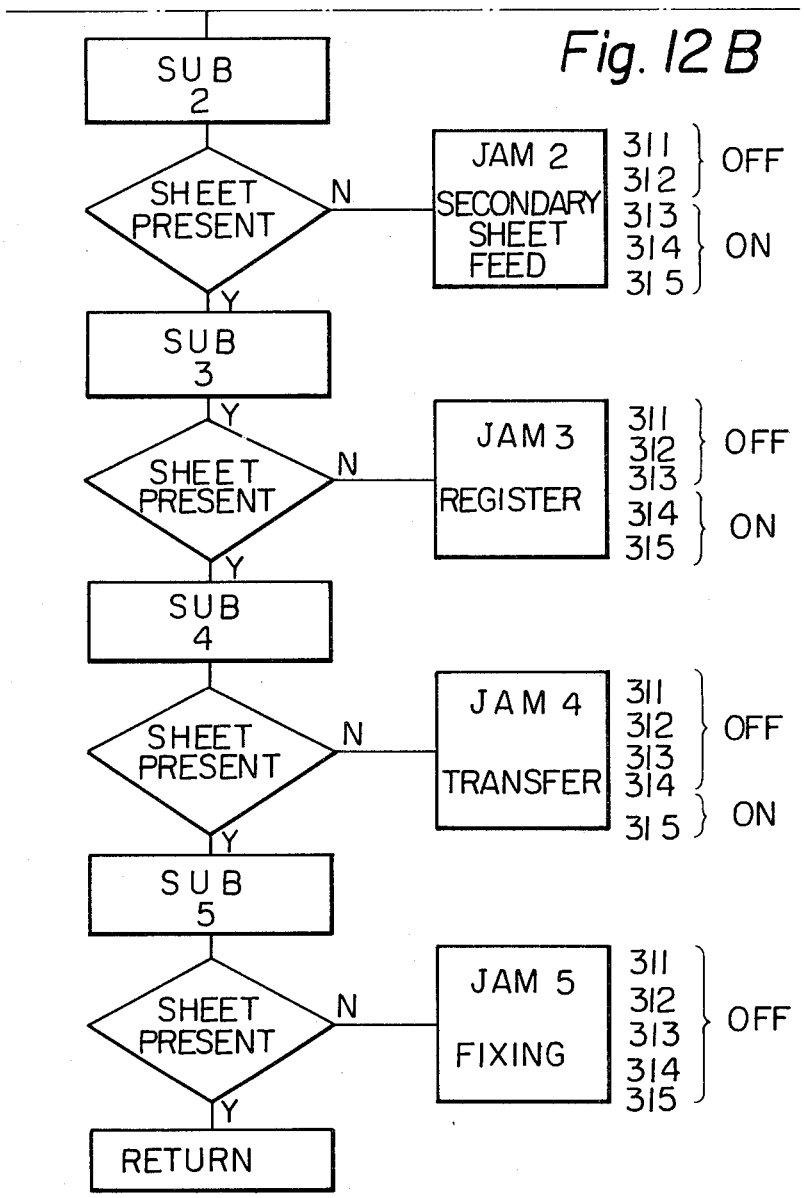

A flowchart illustrating the feed failure or jam sensing operation of the present invention is presented in FIG. 12. After a signal is received indicating that the feed of sheets has started, the program tests to determine if the sheet feed is from the unit 52. If yes, a subroutine 1*a* is executed to sense for the presence of the sheet 56 at the sensor 92 after a predetermined length of time has elapsed which should be sufficient for the sheet 56 to reach the sensor 92. If no, the program continues to determine if the sheet 57 was fed from the unit 53. If yes, a subroutine 1*b* is executed to sense for presence of the sheet 57 at the sensor 93. If no, the program continues to see if the sheet 58 was fed from the unit 54. If yes, a subroutine 1*c* is executed to sense for presence of the sheet 58 at the sensor 94. If no, the program loops back to wait for another sheet feed start.

At the end of the subroutine 1*a*, 1*b* or 1*c*, it is determined whether the sheet 56, 57 or 58 was detected by the respective sensor 92, 93 or 94. If the sheet was sensed, the program proceeds to a subroutine 2. If the sheet was not sensed by the sensor 92, 93 or 94, the program defines a jam 1 condition in the primary sheet feed section and disengages the clutch 311 to stop the rollers 63, 67, 71, 64, 68, 72, 66, 69 and 73. However, the clutches 312, 313 and 314 are maintained engaged to feed out any copy sheets downstream of the primary feed section, or downstream of the sensors 92, 93 and 94.

The subroutine 2 functions to determine if the sheet is sensed by the sensor 96. If yes, the program proceeds to a subroutine 3. If no, the program defines a jam 2 condition in the secondary feed section and disengages the clutches 311 and 312. Disengagement of the clutch 312 causes the rollers 78 and 79 to be stopped.

The subroutine 3 tests to determine if the sheet is sensed by the sensor 97. If yes, the program proceeds to a subroutine 4. If no, the program defines a jam 3 condition in the register section and disengages the clutches 311, 312 and 313. Disengagement of the clutch 313 causes the register rollers 81 to be stopped.

The subroutine 4 functions to see if the sheet is sensed by the sensor 98. If yes, the program proceeds to a subroutine 5. If no, the program defines a jam 4 condition in the transfer section and disengages the clutches 311, 312, 313 and 314. Disengagement of clutch 314 causes the drum 83 and rollers 82 and 86 to be stopped.

The subroutine 5 determines if the sheet is sensed by the sensor 99. If yes, the program returns to control of the other functions of the copying machine 51. If no, the program defines a jam 5 condition in the fixing section and desengages the clutches 311, 312, 313 and 314 as well as de-energizing the main motor 281. This causes all of the feed units of the copying machine 51 to be shut down.

In the case of each jam condition, an indication is provided of the location of the jam or feed failure and the entire copying machine 51 is shut down after sufficient time has elapsed for the copy sheets downstream of the jam to be processed and discharged. The program is constructed in such a manner as to keep track of all sheets in the feed path and individually test for feed failure of each sheet using the logic described with reference to FIG. 12.

In summary, it will be seen that the present invention overcomes the drawbacks of the prior art and provides an electrostatic copying machine comprising means to sense jams or other feed failures of copy sheets and normally process and discharge sheets downstream of the jam in a normal manner. This prevents waste of copy sheets and other materials such as toner which is inherent in prior art copying machines. Various modifications will become possible for those skilled in the art after receiving the teachings of the present disclosure without departing from the scope thereof. For example, the microcomputer 151 may be replaced by a sequential control circuit or any other control means capable of performing the operation of the present invention.

What is claimed is:

1. An electrostatic copying apparatus including sheet feed means for feeding copy sheets down a sheet feed path and a plurality of operating units disposed along the sheet feed path for forming toner images on the copy sheets, the feed means including a plurality of individually drivable feed units spaced along the feed path, characterized by comprising:

sensor means for sensing a copy sheet feed failure in the feed units; and control means for causing all of the feed units to be driven when the sensor means does not sense a feed failure and, when the sensor means does sense a feed failure, energizing only feed units downstream of a feed unit in which the feed failure is sensed;

the operating units comprising a transfer unit for transferring toner images to the copy sheets, a sheet support unit for supporting the copy sheets in a stack prior to feeding by the feed means and a receiving unit for receiving the copy sheets after discharge from the feed means, the feed units comprising a first feed unit for feeding the copy sheets from the support unit to the transfer unit, a second feed unit for feeding the copy sheets through the transfer unit and third feed means for feeding the copy sheets from the transfer unit into the receiving unit.

2. An apparatus as in claim 1, in which the sensor means comprises sensors for sensing presence of copy sheets between the feed units at predetermined respective times.

3. An apparatus as in claim 1, in which the sensor means comprises photosensors.

4. An apparatus as in claim 1, in which the control means comprises a microcomputer.

5. An apparatus as in claim 1, in which the sensor means comprises first, second and third sensors for sensing presence of copy sheets in the first, second and third feed units at predetermined respective times.

* * * * *